US005653138A

United States Patent [19]

Krüger et al.

[11] Patent Number: 5,653,138

[45] Date of Patent: Aug. 5, 1997

[54] METHOD AND APPARATUS FOR FORMING A NECKED AND FLANGED PART ON A HOLLOW CYLINDRICAL BODY

[75] Inventors: Jan Krüger, Essen; Harald Schmidt, Langerwehe; Walter Sommer, Essen, all of Germany

[73] Assignee: Krupp Maschinentechnik Gesellschaft mit beschränkter Haftung, Essen, Germany

[21] Appl. No.: 643,177

[22] Filed: May 6, 1996

[30] Foreign Application Priority Data

May 13, 1995 [DE] Germany ..... 195 17 671.5

[51] Int. Cl.[6] ..... B21D 51/26

[52] U.S. Cl. ..... 72/84; 72/94; 72/105

[58] Field of Search ..... 72/84, 94, 105, 72/106, 110

[56] References Cited

U.S. PATENT DOCUMENTS

| | | | |
|---|---|---|---|
| 2,424,581 | 7/1947 | Peters | 72/94 |
| 2,741,292 | 4/1956 | Butters | 72/94 |
| 3,688,538 | 9/1972 | Hoyne | 72/94 |
| 4,023,250 | 5/1977 | Sproul et al. | 72/84 |

FOREIGN PATENT DOCUMENTS

| | | |
|---|---|---|
| 0 290 874 | 11/1988 | European Pat. Off. . |
| 0 520 693 | 12/1992 | European Pat. Off. . |
| 28 05 321 | 11/1987 | Germany . |

*Primary Examiner*—Lowell A. Larson
*Attorney, Agent, or Firm*—Spencer & Frank

[57] ABSTRACT

A method and an apparatus for forming circumferentially extending necked and flanged parts at an end of a bilaterally open hollow cylindrical body. First and second axially aligned shafts carry axially displaceable first and second inner tools, respectively. Each inner tool has a circumferential body-shaping and a circumferential body-supporting surface. In a first axial position of the two inner tools the shaping surfaces together define a circumferential shaping groove situated inside the hollow body, and the body-supporting surfaces support the hollow body. In a second axial position the two inner tools are at a greater axial distance from one another than in the first position to allow introduction of a hollow body therebetween. A third shaft, carrying an outer tool having a circumferential shaping surface, extends parallel to the first and second shafts. A positioning arrangement is provided for aligning the circumferential shaping surface of the outer tool with the circumferential shaping groove and for radially moving the outer tool towards the two inner tools such that a circumferential portion of the hollow body is deformed and forced into the shaping groove causing the two inner tools to axially spread apart from one another.

15 Claims, 4 Drawing Sheets

METHOD AND APPARATUS FOR FORMING A NECKED AND FLANGED PART ON A HOLLOW CYLINDRICAL BODY

CROSS REFERENCE TO RELATED APPLICATION

This application claims the priority of German Application No. 195 17 671.5 filed May 13, 1995, which is incorporated herein by reference.

BACKGROUND OF THE INVENTION

This invention relates to a method and an apparatus for forming a necked and flanged portion at one end of a bilaterally open cylindrical body, particularly a can body. Such an operation is effected by two inner tools and an outer tool. At least one of the inner tools is rotated by power means. The inner tools are movable axially in the inside of the hollow body relative thereto and subsequently the outer tool is moved radially against the hollow body supported on the inner tools in such a manner that the intended portion of the hollow body is pressed by the outer tool into a concave circumferential contour formed together by the two inner tools. The outer tool and the inner tools are returned into their starting position before deforming a subsequently positioned hollow body.

A conventional apparatus for performing the above-outlined method has two axially movable inner tools for necking and flanging an end region of the cylindrical body. The two inner tools have a contour which corresponds to the intended necked and flanged configuration of the hollow body. At least one of the inner tools is power-driven (rotated). The apparatus further has an outer tool which is movable radially towards the inner tools.

A method and an apparatus of the above-outlined type is disclosed, for example, in published European Application No. 0 290 874. The apparatus disclosed therein is adapted to simultaneously provide necked and flanged portions at both ends of a bilaterally open can body. For each end of the can body the apparatus has a tool assembly, each formed of two inner tools and an outer tool. One of the two inner tools of each tool assembly is a disk affixed to a drivable shaft, while the other of the two inner tools is a swash disk. The fixedly mounted disk has a cylindrical peripheral face adjoined, in the direction of the swash disk, by a tapering contour which corresponds to the necked contour of the finished can body. The diameter of the cylindrical surface is less than the inner diameter of the necked end of the can body and is thus significantly smaller than the inner diameter of the cylindrical wall of the can body. The swash disk, whose radial position is inherently variable and which, accordingly, has no fixed rotary axis, is formed of two annular disks which have the flanged contour of the necked and flanged end of the can body. Both annular disks are radially fixed with respect to one another by an annular shoulder, but are relatively slightly displaceable in the axial direction. The annular shoulder has a diameter which is slightly less than the inner diameter of the non-deformed can body.

It is a disadvantage of the above-outlined conventional apparatus that the can body, because of the diametrical relationships of the inner tools, may be engaged only by a narrow edge of one of the annular disks. Due to this circumstance, a secure entrainment of the can body in the circumferential direction is not ensured and as a result, because of a possible slippage between the can body and the inner tools, the lacquer coating on the can body may be damaged.

Other known devices for neck-forming and flanging the open end of a can body of a two-part can—which in the completed state is formed of two parts, namely, a one-piece bottom-and-can body unit and a lid—essentially comprise a bottom punch which axially immobilizes the can body; two inner tools which, during the neck-forming and flanging phase engage the wall of the can body and an outer tool which effects the neck-forming and the flanging of the can body. Such an apparatus is disclosed, for example, in German Patent No. 2,805,321, to which corresponds U.S. Pat. No. 4,070,888. In the apparatus disclosed therein the two inner tools have different diameters; at least the diameter of one of the two inner tools is substantially less than the inner diameter of the necked can body. The two inner tools are arranged mutually axially displaceably on a common shaft having offset shaft portions. After pulling the can body over the two inner tools by means of the bottom punch, the wall of the can body is pressed against the outer tool by an eccentric feed of the inner tools. While the outer die tool (shaping tool) is axially fixed, the two inner tools are, dependent from the feed depth, axially displaced in mutually opposite directions. Only the outer die tool is driven for rotation; the inner tools thus have to be brought to the desired rpm with the intermediary of the interposed can body. In such a conventional apparatus too, because of the slippage occurring between the can body and the inner tools, lacquer damages on the can body may occur. Further, the ring contour of the outer die tool leads to fold formations in the necked zone of the can body.

In a further known apparatus of the last-described type, the two inner tools also have different diameters and, in such a case too, the diameter of at least one of the two inner tools is substantially smaller than the inner diameter of the necked hollow body forming the rump of a two-part can. Such an apparatus is disclosed in published European Patent Application No. 0 588 048. The inner tools are mounted on a shaft; one of the inner tools is axially displaceable. After inserting the hollow body over the two inner tools and after an eccentric feed of one of the inner tools, the wall of the hollow body is pressed against the inner tools by means of a radial feed of an axially displaceable outer die tool formed of a die roller. The die roller and one of the inner tools are axially displaced as a function of the feed depth. In such a prior art apparatus only the axially displaceable inner tool is driven for rotation. Here too, the lacquer on the hollow body may be damaged and further, a non-uniform flanging may result.

According to yet another conventional apparatus disclosed in European Patent No. 0 520 693, the two axially displaceable and radially fixed inner tools as well as an axially fixed and radially movable outer die tool are provided. Here too, the two inner tools have different diameters and the inner tool with the smaller diameter may rotate in an eccentric position in contact with the hollow body forming the rump of a two-part can. The outer die tool may move radially while the cylindrical hollow body rotates. During this occurrence the outer die tool is pressed into that portion of the hollow body which is to be necked and flanged. This apparatus too, is not capable of producing a uniform flange because of the different diameters of the two inner tools.

SUMMARY OF THE INVENTION

It is an object of the invention to provide an improved method and apparatus of the above-outlined type from which the discussed disadvantages are eliminated and with which a bilaterally open cylindrical hollow body, particularly the rump part of three-part cans may be provided with necked and flanged portions while exposing the can surfaces to a gentle treatment.

This object and others to become apparent as the specification progresses, are accomplished by the invention, according to which, briefly stated, the method includes the following steps:

The two inner tools are introduced into the hollow body from opposite ends thereof and moved within the hollow body in opposite directions toward one another. When the inner tools have reached their smallest distance from one another, they fix the axial position of the hollow body and are force-transmittingly locked thereto. Further, an additional, radially effective force-transmitting connection is established between at least one inner tool and the hollow body. Thereafter the outer tool is pressed against the hollow body to effect deformation thereof.

Because the inner tools are moved from opposite, spaced locations into the hollow body and are returned into their initial position, the parts introduced into the hollow body may have a diameter that is greater than the diameter of the necked part of the hollow body because the inner tools are withdrawn into their initial position in opposite directions from either side of the necked parts. As a result of such a large diameter, a highly satisfactory pre-centering of the hollow body on the inner tools may be effected.

By virtue of the axial force-transmitting lock between the inner tools on the one hand and the hollow body on the other hand, produced at the end of the hollow body, the latter is accelerated to the rpm of the inner tools without exposing the inner surface of the hollow body to frictional stresses.

To protect the inner surface of the hollow body also during the deformation process proper (necking and flanging) from damages that may be caused by slippage, according to an advantageous feature of the invention an additional radial force-transmitting lock is provided between at least one inner tool and the hollow body.

To ensure that the contour defined by the two inner tools for the necking and flanging is as stable as possible, according to a further feature of the invention, the two inner tools are centered as they are axially moved towards one another.

In order to ensure a rapid acceleration of a non-driven inner tool in structures where only one of the inner tools is permanently rotated by a power drive, according to a further feature of the invention, upon completion of the axial movement of the inner tools towards one another, inside the hollow body a torque-transmitting frictional or form-fitting lock is established between the two inner tools.

The apparatus according to the invention includes first and second shafts having respective first and second axes; and first and second inner tools axially displaceably mounted on the first and second shafts, respectively. The first and second inner tools have a first axial position in which shaping surfaces provided on the inner tools together define a circumferential shaping groove and in which the first and second inner tools are adapted to be situated inside the hollow body and adapted to support the hollow body on circumferential supporting surfaces provided on the inner tools. The first and second inner tools have a second axial position in which they are at a greater axial distance from one another than in the first axial position. The greater axial distance ensures a sufficient clearance between the first and second inner tools to allow introduction of a hollow body. There is provided a first axial force-exerting device for urging the inner tools toward one another and a second axial force-exerting device for axially urging them away from one another against a force of the first axial force-exerting device. A third shaft extends radially spaced from the first and second shafts and carries an outer tool. An arrangement supports and rotates the first, second and third shafts. A positioning device aligns a circumferential shaping surface provided on the outer tool with the circumferential shaping groove and radially moves the outer tool towards the first and second inner tools to such an extent as to cause the first and second inner tools to axially spread apart from one another. A radially outwardly acting clamping device is situated in a zone of engagement between the hollow body and at least one of the inner tools. The clamping device includes a mechanism which presses against an inner face of the hollow body for establishing a torque-transmitting connection between the hollow body and one of the inner tools.

By virtue of the inner tools constructed according to the invention, a complete and uniform support of the cylindrical hollow body is achieved whereby the necked and flanged region of the cylindrical hollow body will be uniform to a great degree. By virtue of the fact that the inner tools are mounted on separate shafts, they may be pulled out of the necked hollow body from opposite ends of the hollow body after providing the necked portion thereon. The construction according to the invention thus admits relatively large tools which may be larger than the inner diameter of the necked region. This provides for a substantially improved engagement of the inner tools with the inner wall of the cylindrical hollow body. The outer diameter of the inner tools is less than the inner diameter of the hollow body only to such an extent that an unimpeded displacement of the inner tools is possible into and out of the hollow body.

According to a particularly advantageous feature of the invention a mutual centering of the inner tools is provided during their axial movement towards one another.

For structures in which only one of the inner tools is connected to a power drive, according to a further feature of the invention a torque-transmitting coupling is provided between the two inner tools.

According to a preferred embodiment of the invention the inner tools are provided with abutment rings (abutment flanges) whose diameter is greater than the diameter of the cylindrical hollow body. In this manner a more secure support of the cylindrical hollow body on the two inner tools is ensured.

According to a particularly advantageous feature of the invention, at least one of the inner tools is provided with a separate, rpm-regulated drive motor. In this manner, the rpm of the inner tools and that of the hollow body may be set independently from the rpm of the rotary frame bodies and the radial feed of the outer tool related to one revolution to the hollow body may be set or regulated. In this manner various necked contours may be obtained in an optimal manner.

DESCRIPTION OF THE PREFERRED EMBODIMENTS

Figure 1:
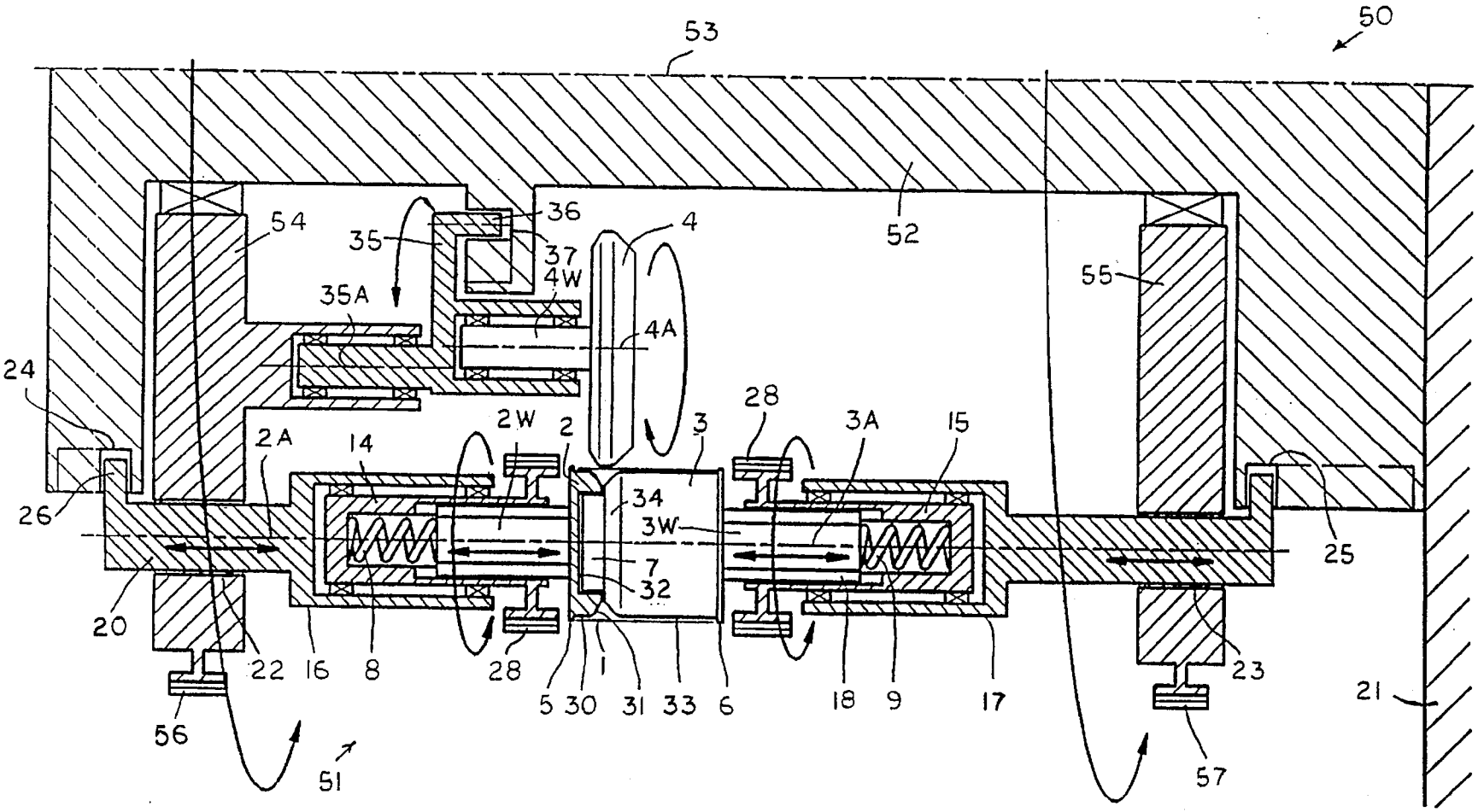
FIG. 1 is an axial sectional view of a rotationally symmetrical half of a preferred embodiment of the invention, illustrating inner tools in an operative, adjoining position.

Turning to FIG. 1, the apparatus generally designated at 50 has a plurality of stations generally designated at 51 to form a necked and a flanged portion of a bilaterally open cylindrical hollow body 1, particularly a can body. Forming a necked and flanged portion is essentially disclosed in U.S. Pat. No. 4,070,888, with particular reference to FIGS. 10–14. The apparatus 50 has a body block 52 which is affixed to a machine stand 21 and which has a central axis 53. Two axially spaced rotary frame bodies 54 and 55 are mounted in the body block 52 for rotation about the axis 53. The stations 51 arranged uniformly about the axis 53 are each supported in the two rotary bodies 54, 55. The rotary bodies 54, 55 are each provided with a ring gear 55, 57 engaging a non-illustrated drive which rotates the bodies 54, 55 synchronously about the axis 53 which may be oriented horizontally (as shown) or vertically. The rotary bodies 54, 55 may be combined into a single, unitary body.

The formation of the necked and the flanged portion of the bilaterally open cylindrical hollow body 1 is effected by two inner shaping tools 2 and 3 and by an outer shaping tool 4. The inner shaping tool 2 is mounted on a shaft 2W having an axis 2A, while the inner shaping tool 3 is mounted on a shaft 3W having an axis 3A. The inner tools 2 and 3 may be introduced from opposite ends into the cylindrical body 1. The axes 2A and 3A are in alignment with one another. The inner tools 2 and 3 are, with their respective shafts 2W and 3W, arranged in sleeves 14, 15 which, in turn, are rotatably supported in respective holders 16 and 17. The shafts 2W and 3W are relatively non-rotatably but axially relatively displaceably mounted in the associated sleeves 14 and 15, for example, by means of a spline 18. The inner tools 2 and 3 are counter-supported by the respective sleeves 14 and 15 with the intermediary of one or more compression springs 8 and 9 such that the spring force in each instance is directed to the respective other inner tool 3 and 2.

Figure 2:
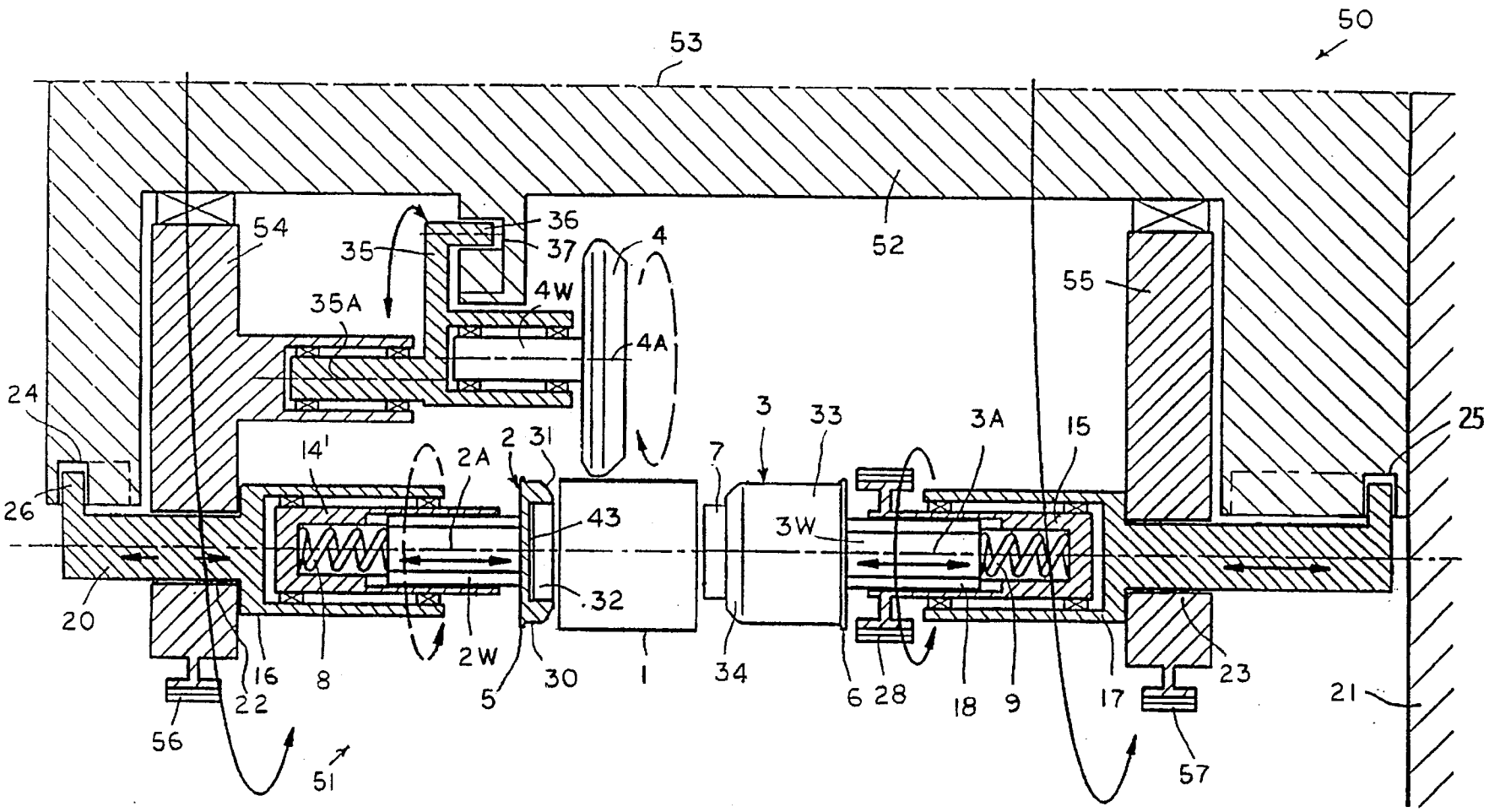
FIG. 2 an axial sectional view of a rotationally symmetrical half of a variant of FIG. 1, illustrating the inner tools in a mutually withdrawn position.

To the holders 16 and 17 respective guide shafts 20 are affixed which are slidably but non-rotatably guided parallel to the axes 2A, 3A in respective guides 22, 23 of the rotary bodies 54, 55. The holders 16 and 17 are moved towards and away from one another by a linear drive composed of a cam track 24, 25 formed in the body block 52 and a follower 26 which extends into the cam track 24, 25. The follower 26 may be a guide roller mounted on the guide shaft 20. In this construction the greatest distance between the two inner tools 2 and 3 must be greater than the length of the hollow body 1 to be worked on, as shown in FIG. 2.

To those ends of the sleeves 14 and 15 which are oriented towards the respective inner tool 2 or 3, an annular gear wheel 28 is secured which is coupled to a non-illustrated rotary drive. It is noted that while in the FIG. 1 construction the two inner tools 2 and 3 have their own, separate power drive to provide a rotary force and consequently both sleeves 14 and 15 carry a gear wheel 28, in the apparatus according to FIG. 2 only the right-hand inner tool 3 has its own power drive and therefore only the sleeve 15 carries a gear wheel 28. The manner in which torque is applied to the left-hand inner tool 2 will be described later. The inner tool 2 has—as viewed in the direction of the inner tool 3—an annular abutment flange 5 to engage one end of the hollow body 1, a short cylindrical portion 30, a tapered portion 31 and a central aperture 32. The inner tool 3 has—as viewed in the direction of the inner tool 2—an annular abutment flange 6 for engaging the other end of the hollow body 1, a relatively long cylindrical part 33 which is longer than the cylindrical portion 30 of the inner tool 2 and whose diameter is slightly smaller than the inner diameter of the hollow body 1, a tapering part 34 and a centering attachment 7. The cylindrical parts 30, 33 serve for circumferentially engaging the hollow body 1 from the inside thereof. Their outer diameters are identical and are slightly smaller than the inner diameter of the hollow body 1 to such an extent that the inner tools 2 and 3 may be easily moved into the hollow body 1—which is held in readiness coaxially with the axes 2A, 3A—from their withdrawn position in which they are remote from one another.

By virtue of the rotation of the inner tools 2, 3 about their own axes 2A and 3A, respectively, the cylindrical body 1 is entrained in rotation. The annular abutment flanges 5, 6 provided on the inner tools 2, 3 position the cylindrical hollow body 1 in the starting phase of the neck-forming and flanging processes and engage the hollow body 1 by a frictional lock provided by the springs 8 and 9. For the mutual centering of the two inner tools 2 and 3 the centering attachment (projection) 7 of the inner tool 3 extends into the aperture 32 of the inner tool 2.

The outer shaping tool 4 is a roller which has a radially outer circumferential shaping surface and which is supported for rotation about an axis 4A in an arm 35 which, in turn, is held in the body 54 for rotation about an axis 35A. The axis 4A is parallel to the axis 35A. The rotary arm 35 is provided with a follower roller 36 which extends into a cam track 37 formed in the body block 52. By means of the cam drive (cam track 37 and follower 36) the outer shaping tool 4 may be moved towards or away from the coaxial axes 2A, 3A by virtue of a circular motion of the axis 4A about the axis 35A. If the outer shaping tool 4 is placed into position, the respective wall portion of the cylindrical hollow body 1 is pressed in the direction of the shaping groove formed together by the tapering (shaping) portions 31, 34 of the inner tools 2 and 3. The extent of radial feed of the outer tool 4—determined by the course of the cam track 37 and the space between the axes 4A and 35A—is expediently so designed that the outer tool 4 spreads apart the inner tools 2 and 3 against the force of the springs 8, 9. In this manner the degree of taper of the neck portion may be varied or set. At the same time, as the outer end of the hollow body 1 engages and axially slides on the tapering end 31 of the inner tool 2, an outwardly directed flange is obtained, so that altogether there is formed a necked and flanged edge region on the hollow body 1.

Figure 4:
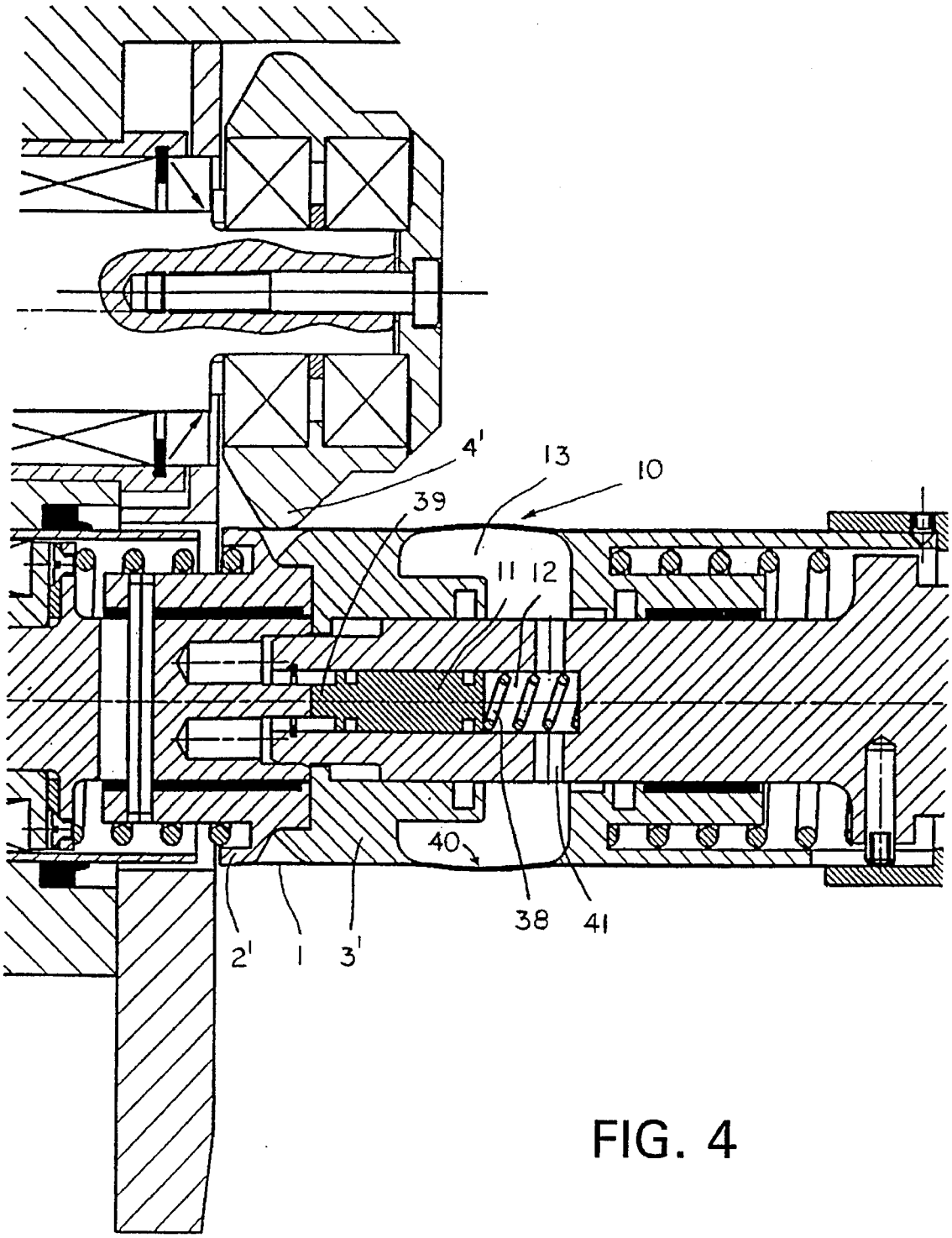
FIG. 4 is a fragmentary axial sectional view of another preferred embodiment of the invention, including a clamping device.

Turning to FIG. 4, the apparatus illustrated therein has inner shaping tools 2', 3' and an outer shaping tool 4'. The inner tool 3' is provided with a radially effective clamping device 10 having a clamping piston 11, a cylinder 12 receiving the piston 11 and a clamping chamber 13. The piston 11 is pressed by a compression spring 38 in the direction of the inner tool 2'. When the inner tools 2', 3' are moved axially away from one another for receiving a hollow body 1, the piston 11 is pressed outwardly to such an extent that an attachment or projection 39 of the piston 11 extends outwardly from the inner tool 3'.

The clamping chamber 13 is constituted by a cavity in the inner tool 3', bounded by a very thin outer wall 40. The clamping chamber 13 is in hydraulic communication with the cylinder 12 by means of a radial port 41. Both chambers 12 and 13 as well as the port 41 are filled with a hydraulic fluid. When the inner tools 2' and 3' are moved toward one another to receive a hollow body 1, a part of the frontal face of the inner tool 2' presses the piston 11 into the cylinder 12 via the projection 39. The hydraulic fluid displaced during this occurrence is driven into the clamping chamber 13 and expands the thin wall portion 40 outwardly as shown in a somewhat exaggerated representation in FIG. 4. The expanded outer wall portion 40 presses against the wall of the hollow body 1 and thus provides for a good frictional connection between the inner tool 3' and the hollow body 1 whereby an optimum torque transmission is ensured.

As noted earlier, in the embodiment shown in FIG. 2, only the right-hand inner tool 3 is rotated by a power drive. The inner tool 3, as described in connection with the inner tool 3', is provided with a clamping device 10. In the description which follows, the torque-transmission to the non-driven inner tool 2 will be explained.

As the inner tools 2 and 3 are moved towards one another by means of the control grooves, the centering attachment 7 of the inner tool 3 slides into the recess 32 of the inner tool 2. Upon completion of the movement towards one another, the centering attachment 7 presses against a frictional insert 43 accommodated in the recess 32. The frictional insert 43 and the centering attachment 7 together form a frictional coupling between the two inner tools 2 and 3 and, as a result, the inner tool 2 is driven by the inner tool 3 each time the two inner tools have been driven to one another and assume their operative, adjoining relationship.

Figure 3:
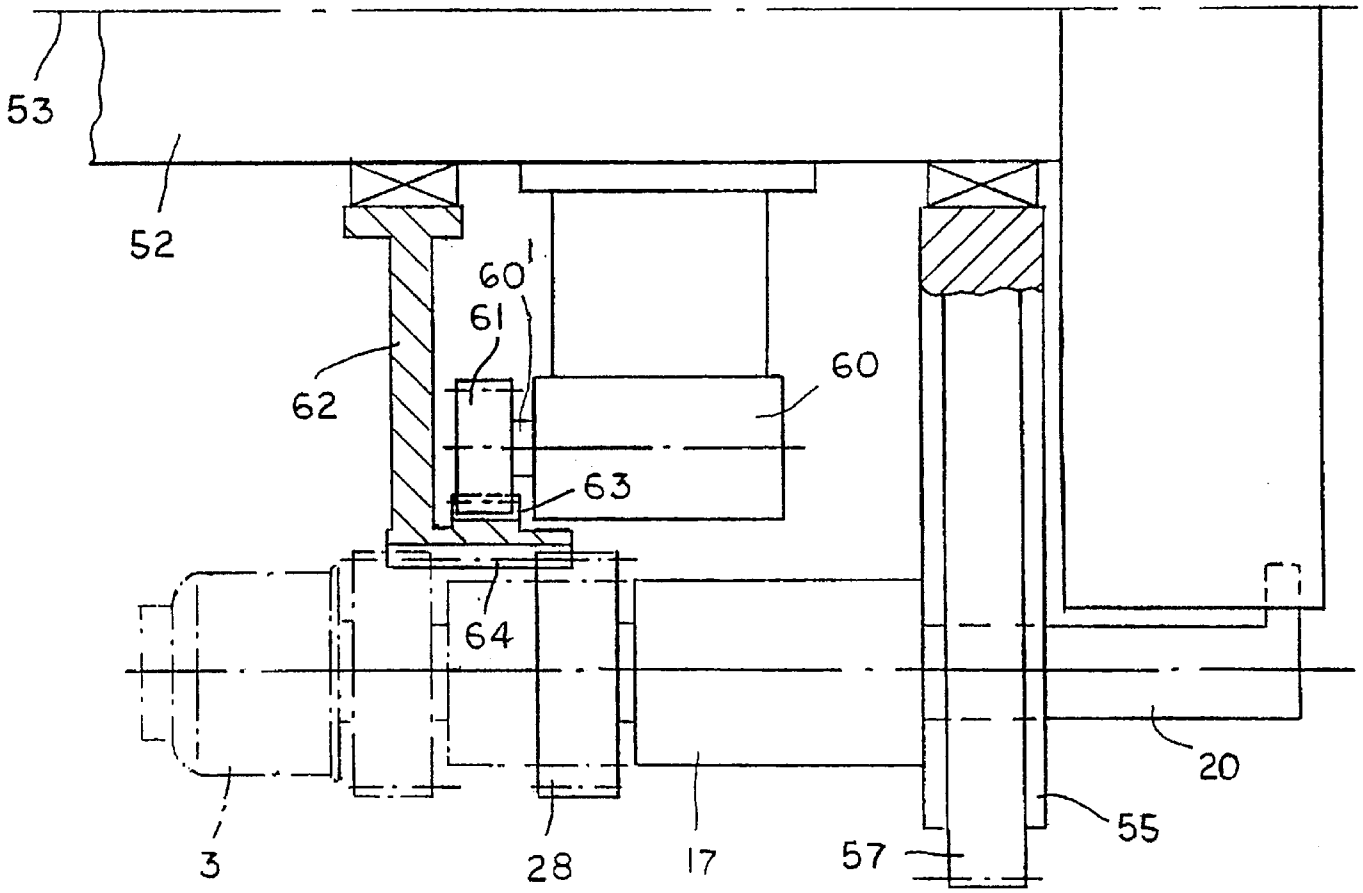
FIG. 3 is a schematic side elevational view of a drive assembly of an inner tool shown in FIGS. 1 and 2.

FIG. 3 illustrates the power drive assembly for the inner tool 3. The gear 28 carried by the sleeve 15 (not shown in FIG. 3) and the holder 17 are shown in dash-dot lines in the working position and in full lines in the withdrawn position. A motor 60 is mounted on the body block 52 and has a pinion 61 carried by a motor shaft 60'. The pinion 61 meshes with inner teeth 63 of a gear 62. The gear 62 further has outer teeth 64 which, in turn, mesh with the gear 28. To ensure that a meshing relationship between teeth 64 and gear 28 is preserved despite axial displacements of the gear 28, the outer teeth 64 have an appropriately dimensioned, axially measured width.

The motor 60 is rpm-regulated, dependent from the rpm of the rotary frame bodies 54, 55. By virtue of this arrangement, the positioning (radial feed) of the outer tool 4 determined by the control groove 37 relative to one revolution of the inner tools 2, 3 and that of the hollow body 1 may be varied.

It will be understood that the above description of the present invention is susceptible to various modifications, changes and adaptations, and the same are intended to be comprehended within the meaning and range of equivalents of the appended claims.

What is claimed is:

1. A method of forming circumferentially extending necked and flanged parts at an end of a bilaterally open hollow cylindrical body, comprising the following steps:

(a) providing two axially aligned and axially displaceable inner tools, together forming a concave circumferential groove;

(b) providing a radially displaceable outer tool for pressing a circumferential portion of the hollow body into the concave circumferential groove for forming the necked and flanged parts;

(c) introducing the two inner tools into the hollow body through opposite ends thereof from an initial position in which the two outer tools are remote from one another;

(d) moving the two inner tools in opposite directions towards one another until the two inner tools assume an adjoining, operational position relative to one another;

(e) upon reaching said adjoining, operational position, causing said two inner tools to axially fix the hollow body and to lock the hollow body thereto at least at one first location of the hollow body;

(f) generating a radially acting additional lock between at least one of said two inner tools and the hollow body at a second location thereof;

(g) pressing said portion of the hollow body by said outer tool into said groove for forming the necked and flanged parts on the hollow body; and (h) upon completion of step (g), returning said two inner tools into said initial position.

2. The method as defined in claim 1, further comprising the step of centering said inner tools relative to one another during performance of step (d).

3. The method as defined in claim 1, further comprising the step of providing a torque-transmitting connection between said two inner tools upon completion of step (d).

4. The method as defined in claim 1, wherein step (g) comprises the step of causing, by a radial motion of said outer tool, an axial separation of said inner tools with respect to one another.

5. An apparatus for forming circumferentially extending necked and flanged parts at an end of a bilaterally open hollow cylindrical body, comprising (a) a first shaft having a first axis;

(b) a separate second shaft having a second axis; said first and second axes being axially aligned with one another;

(c) a first inner tool mounted on said first shaft and being axially displaceable along said first axis; said first inner tool having a first circumferential shaping surface and a first circumferential supporting surface;

(d) a second inner tool mounted on said second shaft and being axially displaceable along said second axis; said second inner tool having a second circumferential shaping surface and a second circumferential supporting surface; said first and second inner tools having a first axial position in which said first and second shaping surfaces together define a circumferential shaping groove and in which said first and second inner tools are adapted to be situated inside the hollow body and adapted to support the hollow body on said first and second circumferential supporting surfaces; said first and second inner tools having a second axial position; in said second axial position said first and second inner tools being at a greater axial distance from one another than in said first axial position; said greater axial distance providing a sufficient clearance between said first and second inner tools to allow introduction of a hollow body in a direction generally perpendicular to said first and second axes;

(e) first axial force-exerting means for axially urging said first and second inner tools toward one another;

(f) second axial force-exerting means for axially urging said first and second inner tools away from one another against a force of said first axial force-exerting means;

(g) a third shaft extending radially spaced from said first and second shafts;

(h) an outer tool mounted on said third shaft and having a third circumferential shaping surface;

(i) means for supporting and rotating said first, second and third shafts;

(j) positioning means for aligning said third circumferential shaping surface with said circumferential shaping groove and for radially moving said outer tool towards said first and second inner tools to such an extent as to cause said first and second inner tools to axially spread apart from one another; and (k) a radially outwardly acting clamping device situated in a zone of engagement between the hollow body and at least one of said inner tools; said clamping device including means pressing against an inner face of the hollow body for establishing a torque-transmitting connection between the hollow body and said one inner tool.

6. The apparatus as defined in claim 5, further comprising a power drive included in said means for supporting and rotating; said power drive being connected to at least one of said first and second inner tools for applying a driving torque thereto; said clamping device being carried by said at least one inner tool connected to said power drive.

7. The apparatus as defined in claim 5, further comprising a centering projection attached to and extending axially from one of said first and second inner tools toward the other of said first and second inner tools and a recess provided in said other of said first and second inner tools; said recess being oriented towards and being in an axial alignment with said projection; in said first axial position of said first and second inner tools said projection being received in said recess.

8. The apparatus as defined in claim 5, further comprising hydraulic means for operating said clamping device.

9. The apparatus as defined in claim 5, further comprising mechanical means for operating said clamping device.

10. The apparatus as defined in claim 5, wherein said clamping device is mounted in axial alignment with and adjacent to said first and second inner tools; further comprising means for effecting rotation of said clamping device in unison with said first and second inner tools; said clamping device including radially expanding means for pressing against an inner wall portion of the hollow body and operating means for spreading and retracting said expanding means.

11. The apparatus as defined in claim 10, wherein said radially expanding means comprises a radially flexible circumferential wall portion and further wherein said operating means includes hydraulic actuating means for expanding said wall portion.

12. The apparatus as defined in claim 5, further comprising a power drive included in said means for supporting and rotating; said power drive being connected to at least one of said first and second inner tools for applying a driving torque thereto; said power drive including an rpm-regulated motor.

13. The apparatus as defined in claim 5, further comprising coupling means for torque-transmittingly connecting said first and second inner tools with one another in said first axial position thereof.

14. The apparatus as defined in claim 5, further comprising a separate circumferential abutment flange provided on said first and second inner tools for axially abutting opposite ends of the hollow body when positioned on said first and second inner tools.

15. The apparatus as defined in claim 5, wherein said first and said second supporting surfaces are cylindrical and have identical diameters.

* * * * *